US005440779A

United States Patent [19]

Collinson

[11] Patent Number: 5,440,779

[45] Date of Patent: Aug. 15, 1995

[54] MOISTURE REMOVAL FROM METAL STRIP

[75] Inventor: Christopher D. Collinson, Poole, England

[73] Assignee: Davy McKee (Poole) Limited, Dorset, England

[21] Appl. No.: 182,133

[22] PCT Filed: Oct. 28, 1992

[86] PCT No.: PCT/GB92/01975

§ 371 Date: May 26, 1994

§ 102(e) Date: May 26, 1994

[87] PCT Pub. No.: WO93/08939

PCT Pub. Date: May 13, 1993

[30] Foreign Application Priority Data

Nov. 1, 1991 [GB] United Kingdom ..... 9123244
Nov. 4, 1991 [GB] United Kingdom ..... 9123398

[51] Int. Cl.[6] ..... B21B 45/02

[52] U.S. Cl. ..... 15/309.1; 15/316.1; 15/319; 15/345

[58] Field of Search ..... 15/306.1, 309.1, 309.2, 15/316.1, 319, 345

[56] References Cited

U.S. PATENT DOCUMENTS 3,601,837 8/1971 Conrad et al. ..... 15/316.1 X
3,849,831 11/1974 DeVerter et al. ..... 15/316.1 X
4,395,793 8/1983 Wedel et al. ..... 15/316.1 X

*Primary Examiner*—Christopher K. Moore
*Attorney, Agent, or Firm*—Lee, Mann, Smith, McWilliams, Sweeney & Ohlson

[57] ABSTRACT

To remove moisture from an edge region (5) of moving metal strip (S), apparatus is provided which comprises a hollow housing (7) having a slot (9) in a wall which permits the edge region (5) of the strip (S) to pass through the slot (9), nozzles (19, 21) in the housing (7) direct jets of air on to the upper and lower surfaces of the strip. Any moisture on the strip (S) is blasted off the strip into the housing (7) from where it is exhausted with the air.

5 Claims, 1 Drawing Sheet

MOISTURE REMOVAL FROM METAL STRIP

Figure 1:
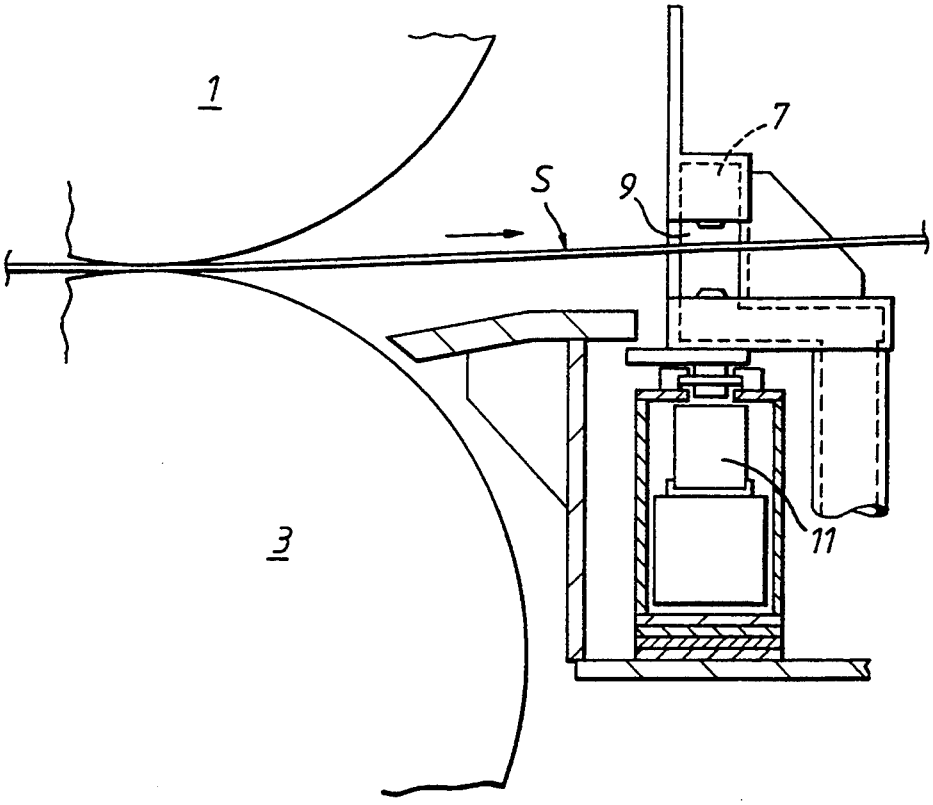

This invention relates to apparatus for removing moisture from an edge region of metal strip that is moving in the direction of its length. In particular, the apparatus is for removing moisture from an edge region of aluminium strip.

The final rolling stages of aluminium strip consist of rolling the strip through a number of rolling mill stands, sometimes arranged in tandem, so that the strip leaving the last stand is of the required gauge. This strip is then coiled for subsequent use. The rolls of the mill stands are cooled by having liquid coolant applied to them on the entry side. It has been the practice to employ kerosene as the liquid coolant. However, for various reasons, it would be preferable to use water as the liquid coolant, but it is absolutely vital to keep water off the strip on the exit side of the mill when it is coiled because water left on the surface of the coiled strip dries and causes considerable staining of the strip rendering it unacceptable to many potential users.

Steps may be taken to remove any moisture remaining on the upper and lower surfaces of the strip downstream of the last stand to avoid staining of the aluminium strip. However, it is known for a thin layer of moisture to remain on the longitudinally extending edge regions of the metal strip and particularly moisture taking the form of a bead which attaches itself to the extreme edge of the strip. When the strip is coiled the moisture on the edge region of the strip, particularly the bead of moisture on the edge region, seeps back into the coil between adjacent turns and, as it dries, it stains the aluminium. For many applications of the aluminium strip, staining of the edges is not acceptable.

According to the present invention, apparatus for removing moisture from an edge region of metal strip moving in the direction of its length is characterised in that it comprises a hollow housing having a slot in an outer wall thereof; means for supporting the housing relative to the path taken by the strip so as to permit the edge region of the moving strip to project into the slot and be in communication with the interior of the housing; nozzle assemblies in the housing by which air under pressure is directed on to the upper and lower surfaces of the edge region of the strip in the slot, the air being directed towards the edge of the strip so as to remove any moisture present on the strip; and means for extracting air and moisture from the housing.

The jets of air leaving the nozzle assemblies wipe across the longitudinally extending edge regions of the upper and lower surfaces of the strip displacing the moisture therefrom in the form of droplets and particularly removing the bead of moisture which may be present on the edge of the strip. This bead is smashed by the turbulent air and is taken with the air into the hollow housing in the form of a mist from where it is extracted.

Conveniently, such apparatus is provided for removing moisture from both longitudinally extending edge regions of the metal strip.

Conveniently, the housing is so mounted that it can be moved in a direction parallel to the width dimension of the strip so that the apparatus can be used with strips of different widths.

Detector means may be provided in the housing to detect the position of the edge of the strip and control means are employed to automatically displace the housing towards and away from the edge of the strip so that the edge remains at a desired position relative to the nozzle assemblies which are in the housing.

Figure 2:
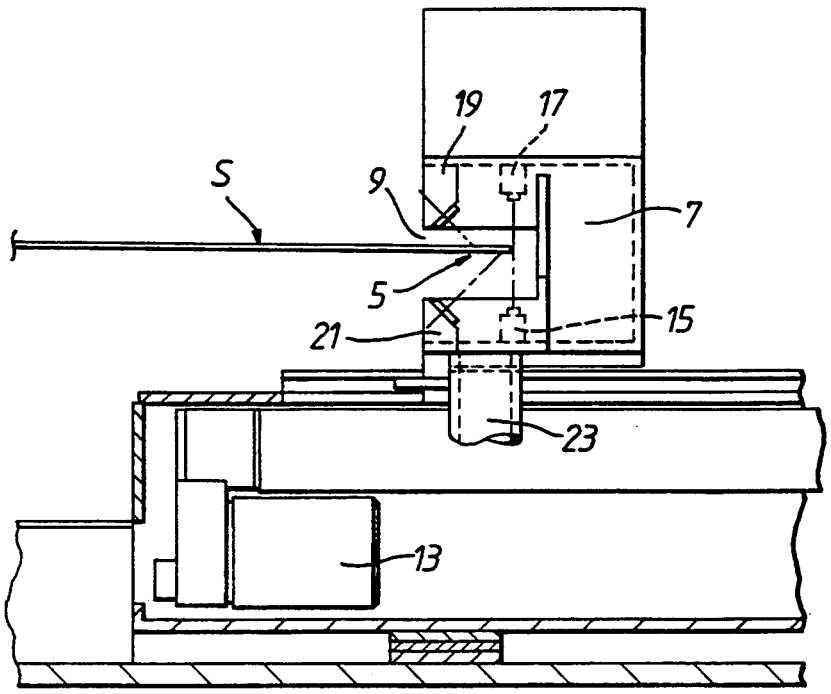

In order that the invention may be more readily understood, it will now be described, by way of example only, with reference to the accompanying drawings, in which:

FIG. 1 is a side elevation, partly in section, of a rolling mill stand showing apparatus in accordance with the present invention; and FIG. 2 is an end elevation of the apparatus shown in FIG. 1.

A rolling mill for rolling metal strip, particularly aluminium strip, has a pair of work rolls 1, 3. A number of rolling mill stands may be arranged in tandem and, downstream of the last stand, there is provided apparatus in accordance with the present invention for removing moisture from one of the longitudinally extending edge regions of the metal strip S.

In use, coolant water is applied to the rolls 1, 3 on the entry side of the mill. Usually steps are taken to contain the coolant in contact with particular peripheral portions of the rolls on the entry side of the mill and steps may also be taken to prevent liquid coolant from coming into contact with the strip material on the downstream side of the last stand to prevent staining of the strip material as the liquid coolant dries.

It has been found, however, that, in practice, moisture tends to collect on the extreme longitudinally extending edge regions 5 of the strip S, particularly, a bead of moisture may be formed on the edge of the strip. Apparatus for removing the moisture is provided adjacent both of the longitudinally extending edge regions of the metal strip, although only one such apparatus is shown in FIGS. 1 and 2.

The apparatus comprises a hollow housing 7 having a slot 9 formed in the outside wall of the housing which permits the longitudinally extending region 5 of the strip to project into the slot. The slot is in communication with the interior of the housing. The housing is mounted on a slider 11 which is driven by an electric motor 13 in such a manner that the housing can be moved towards and away from the strip S in the direction of its widthwise dimension. A position detector comprising a transmitter 15 and a receiver 17 are mounted in the housing on opposite sides of the slot and they serve to detect the edge of the strip material when it is present in the slot. Signals from the detector are employed by means not shown to drive the motor 13 to move the housing so that the edge of the strip always takes the same relative position in the slot 9. Also provided in the housing on opposite sides of the slot are a pair of nozzles 19, 21 which are supplied with gas, usually air, under pressure. The nozzles are directed so that the gas issuing from them impinges on the upper and lower surfaces of the strip material, respectively, and they are inclined to the respective surfaces of the strip and directed towards the edge of the strip. The angle at which the air jet impinges against one surface is substantially at right angles to the angle at which the air jet impinges against the other surface. In this way, air issuing from the nozzles impinges on the surfaces of the strip as it passes through the housing and converts any moisture which is on the edge region of the strip into droplets which are carried by the air stream. Furthermore, the air flowing over the surfaces of the strip meets at the edge of the strip and fragments any bead of moisture which has attached itslf thereto. Thus, all moisture present on the longitudinally extending edge region of the strip is converted into droplets by the air jets and removed into the hollow housing. The air containing the droplets of moisture is in the form of a mist and is exhausted from the housing through an exhaust pipe 23 by means of a suction generating device (not shown).

As mentioned above, when coolant water is applied to the rolls on the entry side of the mill, it is usual to contain the coolant within box structures which define chambers. At the junction between the box structures and the roll surfaces, a sealing strip is provided to prevent the coolant from being deposited on that part of the roll which would allow the coolant to be deposited on the strip on the outgoing side of the mill. If desired, the interior of the housing 7 may include a device for analysing the moisture content in the housing since this is indicative of the quantity of the seals between the box structures and the rolls. An increase in moisture content could indicate that one or other of the seals is breaking down.

I claim:

1. Apparatus for removing moisture from an edge region of metal strip moving in the direction of its length, characterised in that it comprises a hollow housing having a slot in an outer wall thereof; means for supporting the housing relative to the path taken by the strip so as to permit the edge region of the moving strip to project into the slot and be in communication with the interior of the housing; nozzle assemblies in the housing by which air under pressure is directed on to the upper and lower surfaces of the edge region of the strip in the slot, the air being directed towards the edge of the strip so as to remove any moisture present on the strip; and means for extracting air and moisture from the housing.

2. Apparatus as claimed in claim 1, characterised in the provision of detector means in the housing which serve to detect the position of the edge of the strip relative to the housing and means for automatically displacing the housing in the direction towards or away from the path taken by the strip so that the housing remains at a desired position relative to the edge of the strip.

3. Apparatus as claimed in claim 2, characterised in that the housing is mounted on a slider and an electric motor under the control of the detector means displaces the slider in the direction towards or away from the path taken by the strip.

4. Apparatus as claimed in claim 1, characterised in that the nozzle assemblies are arranged such that the air under pressure directed on to the upper surface of the strip is substantially at right angles to the air under pressure directed on to the lower surface of the strip.

5. Apparatus as claimed in claim 1, characterised in that means are provided in the housing for determining the moisture content of the air therein.

* * * * *